US009049930B1

(12) United States Patent
Chambers et al.

(10) Patent No.: US 9,049,930 B1
(45) Date of Patent: Jun. 9, 2015

(54) CABINET DRAWER FLOOR AND FENCE ASSEMBLY

(71) Applicant: Rev-A-Shelf Company, LLC, Jeffersontown, KY (US)

(72) Inventors: Paul F. Chambers, Louisville, KY (US); Kevin M. Ward, Jr., Louisville, KY (US); David P. Noe, Louisville, KY (US)

( * ) Notice: Subject to any disclaimer, the term of this patent is extended or adjusted under 35 U.S.C. 154(b) by 0 days.

(21) Appl. No.: 14/141,866

(22) Filed: Dec. 27, 2013

(51) Int. Cl.
*A47B 88/00* (2006.01)

(52) U.S. Cl.
CPC ..... *A47B 88/0003* (2013.01)

(58) Field of Classification Search
CPC .... A47B 51/00; A47B 88/20; A47B 88/0014; A47B 67/02; A47B 88/06; A47B 77/16
USPC ..... 312/184, 211, 212, 270.1–270.3, 273, 312/298, 308, 310, 330.1, 348.1–348.3; 220/909
See application file for complete search history.

(56) References Cited

U.S. PATENT DOCUMENTS

| | | | | |
|---|---|---|---|---|
| 2,934,390 | A | 4/1960 | Wright | |
| 4,173,380 | A * | 11/1979 | Dupree | 312/330.1 |
| 4,579,402 | A | 4/1986 | Wenzlick et al. | |
| 5,634,702 | A | 6/1997 | Fistonich | |
| 5,733,026 | A | 3/1998 | Munachen | |
| 5,938,305 | A | 8/1999 | Rubsam-Tomlinson | |
| 6,007,172 | A | 12/1999 | Shufelt et al. | |
| 6,099,099 | A | 8/2000 | Shufelt et al. | |
| 6,193,340 | B1 * | 2/2001 | Schenker et al. | 312/265.5 |
| 6,390,576 | B1 | 5/2002 | Walburn | |
| 7,204,569 | B2 | 4/2007 | Walburn | |
| D596,424 | S | 7/2009 | Noe et al. | |
| 8,047,621 | B2 | 11/2011 | Walburn | |
| 8,091,971 | B2 | 1/2012 | Ward et al. | |
| 8,388,076 | B2 | 3/2013 | Walburn | |
| 2007/0024166 | A1 | 2/2007 | Sung | |

* cited by examiner

*Primary Examiner* — Matthew Ing
(74) *Attorney, Agent, or Firm* — Brinks Gilson & Lione

(57) ABSTRACT

A cabinet drawer includes a molded drawer floor having a central portion including at least one depression, each depression having a bottom wall and a sidewall having an inner surface and an outer surface. A flange extends outwardly from an upper edge of each depression. A plurality of webs extends outward from each depression outer surface for connection with a drawer slide system. A peripheral edge of the flange includes a plurality of deflectable tabs for coupling to a surrounding fence without the use of fasteners. The fence includes a skirt portion extending downward from the drawer floor flange to hide any drawer slide mechanism coupling the drawer floor to any underlying base.

21 Claims, 14 Drawing Sheets

CABINET DRAWER FLOOR AND FENCE ASSEMBLY

CROSS-REFERENCE TO RELATED APPLICATION

The present application is being filed concurrently with our application entitled ADJUSTABLE FACE PANEL MOUNTING ASSEMBLY, which is hereby incorporated by reference in its entirety.

BACKGROUND

1. Technical Field

The present disclosure relates to cabinet drawers, and more particularly relates to floor and fence assemblies used to support and surround removable containers.

2. Background Information

Most drawers typically consist of a bottom surrounded by four upright members defining a back wall, two side walls, and a drawer front. The contents of the drawer can be accessed through an open horizontal plane defined generally by the upper margins of the back wall and two side walls. To facilitate such access, a drawer slide can be coupled to each side of the drawer and to each side of the drawer receiving opening in the cabinet holding the drawer. Each drawer slide consists generally of a first rail that is designed to be fixed to the side of the drawer and a second rail that is designed to be fixed to the cabinet. The first and second rails are coupled to each other by inter-engaging surfaces such a glides or bearings that facilitate relative movement between the two rails. A wide variety of such drawer slides exist that are suitable for use to permit drawers to move smoothly and easily in and out of cabinetry, particularly cabinetry typically found in kitchens.

Some drawers have a different construction from that previously described. In particular, some drawers, for example drawers typically situated in under-counter cabinets that include one or more waste containers. An example is to be found in Ward et al. U.S. Pat. No. 8,091,971, the entirety of which is hereby incorporated by reference. The drawer consists of a bottom designed to support the waste containers, and may include a back wall, and side walls for maintaining the waste container in an upright position. To facilitate access, drawer slides can be coupled to an under structure supporting the drawer bottom and to the bottom of the drawer receiving opening in the cabinet holding the drawer. A soft-close mechanism can be included in the understructure supporting the drawer bottom. More recently, there has been a desire to provide such drawers that are lighter so that they can be move inward and outward with greater ease. There has also been a desire to provide such drawers that are more easily cleaned and prevent trash from falling under the drawer to ensure good hygiene in food preparation areas and other situations where such built in waste disposal drawer systems are employed.

BRIEF SUMMARY

A cabinet drawer can include a molded drawer floor having a central portion including at least one depression, each depression having a bottom wall and a sidewall having an inner surface and an outer surface. A flange can extend outwardly from an upper edge of the at least one depression. A plurality of webs can extend outward from the at least one depression outer surface for connection with a drawer slide system. A peripheral edge of the flange can include a plurality of deflectable tabs for coupling to a surrounding fence. The molded drawer floor can be injection molded or vacuum formed of polymers such as polystyrene, ABS, acrylic, polycarbonate, and polyvinylchloride.

In one embodiment, each of the plurality of deflectable tabs on the peripheral edge of the flange can include a projection directed in a first selected direction. The drawer floor can further comprise a second plurality of deflectable tabs projecting outward from the outer surface of the at least one depression. Each of the second plurality of deflectable tabs can include a projection directed in a second selected direction opposite the first selected direction. A lip can depend downwardly from the peripheral edge of the flange. A plurality of ridges can be provided on a lower surface of the flange extending between the lip and the outer surface of the at least one depression. The bottom wall of each depression can include a U-shaped trough spaced inward from the sidewall.

In one embodiment, the surrounding fence can include a skirt portion coupled to the deflectable tabs of the floor peripheral edge. The fence can also include a plurality of legs projecting upwardly from the skirt portion. A top perimeter portion of the fence can be connected to upper ends of the plurality of legs. The skirt portion can have a tubular upper margin including a step on a lower surface engaging at least one of the deflectable tabs. A planar member can extend downward from an outer surface of the tubular upper margin to hide any drawer slide mechanism coupled to the molded floor. A flange can be directed inwardly from an inner surface of the planar member that can have a step on an upper surface for engagement with the molded floor. The plurality of legs projecting upwardly from the skirt portion can have a surface shape corresponding to the tubular upper margin of the skirt portion.

In one embodiment, the legs and top portion of each side of the fence can be made by selecting a length of hollow bar stock having a total length equal to the length of the top portion and both legs. Both ends of the hollow bar stock can be cut on a diagonal and the corner portions removed. Two triangular cuts are made in such a way as to leave one wall of the hollow bar stock intact, and the two triangular portions are removed. A bending force can then be applied to the one continuous wall of the hollow bar stock at two positions outside the locations of the removal of the triangular portions, causing the hollow bar stock to bend to form the legs and top portion as a single unitary piece. The ends of the legs can then be secured to ends of a skirt portion by fasteners. Thus, each side of the fence can be quickly assembled using only two fasteners.

These and other features and advantages of the present invention will become apparent to those skilled in the art from the following description of a preferred embodiment of the present invention that is illustrated in the accompanying drawings.

DETAILED DESCRIPTION OF THE PREFERRED EMBODIMENTS

Figure 1:
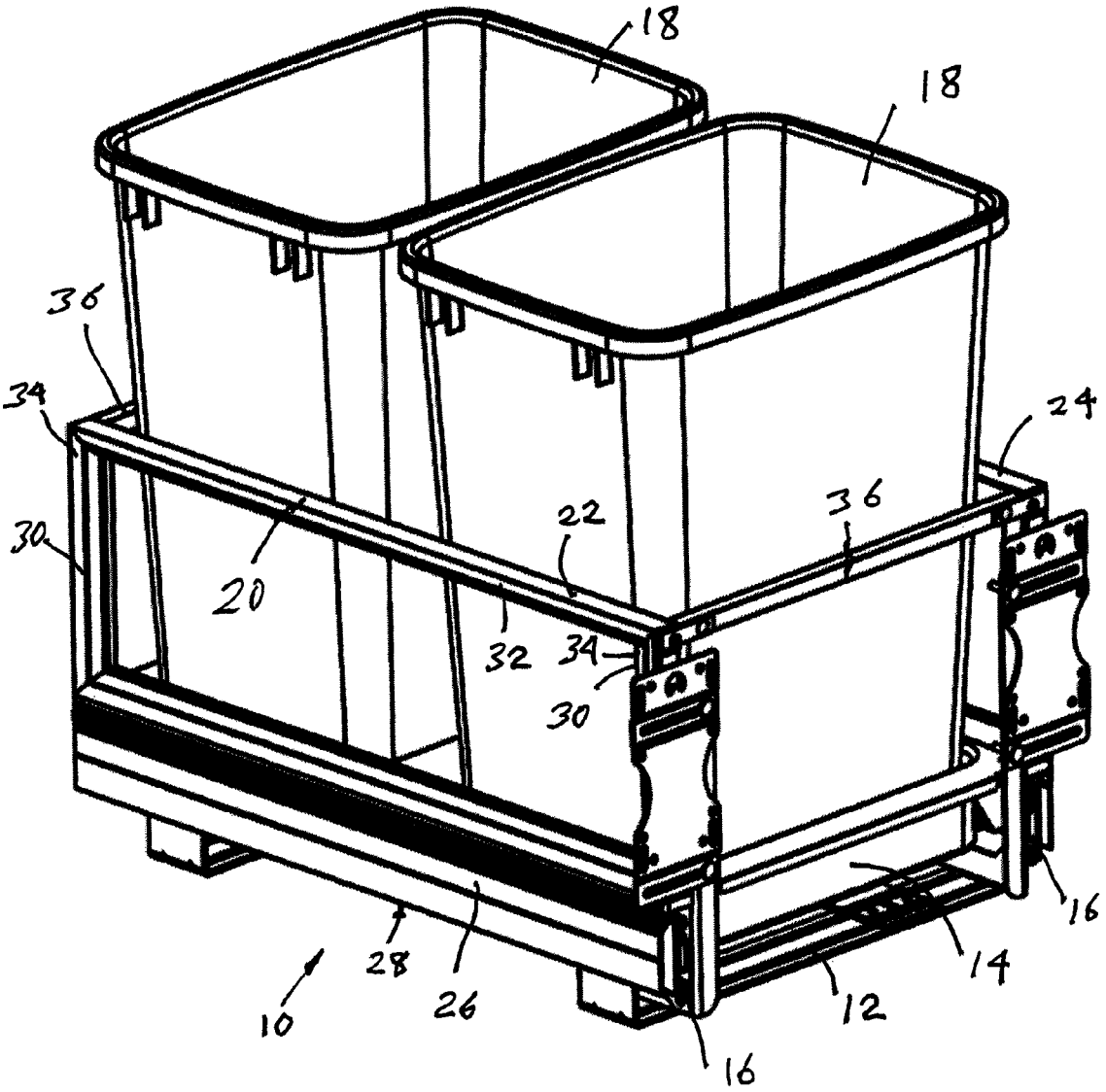
FIG. 1 is a perspective view of a cabinet drawer with a molded floor and fence.
Figure 2:
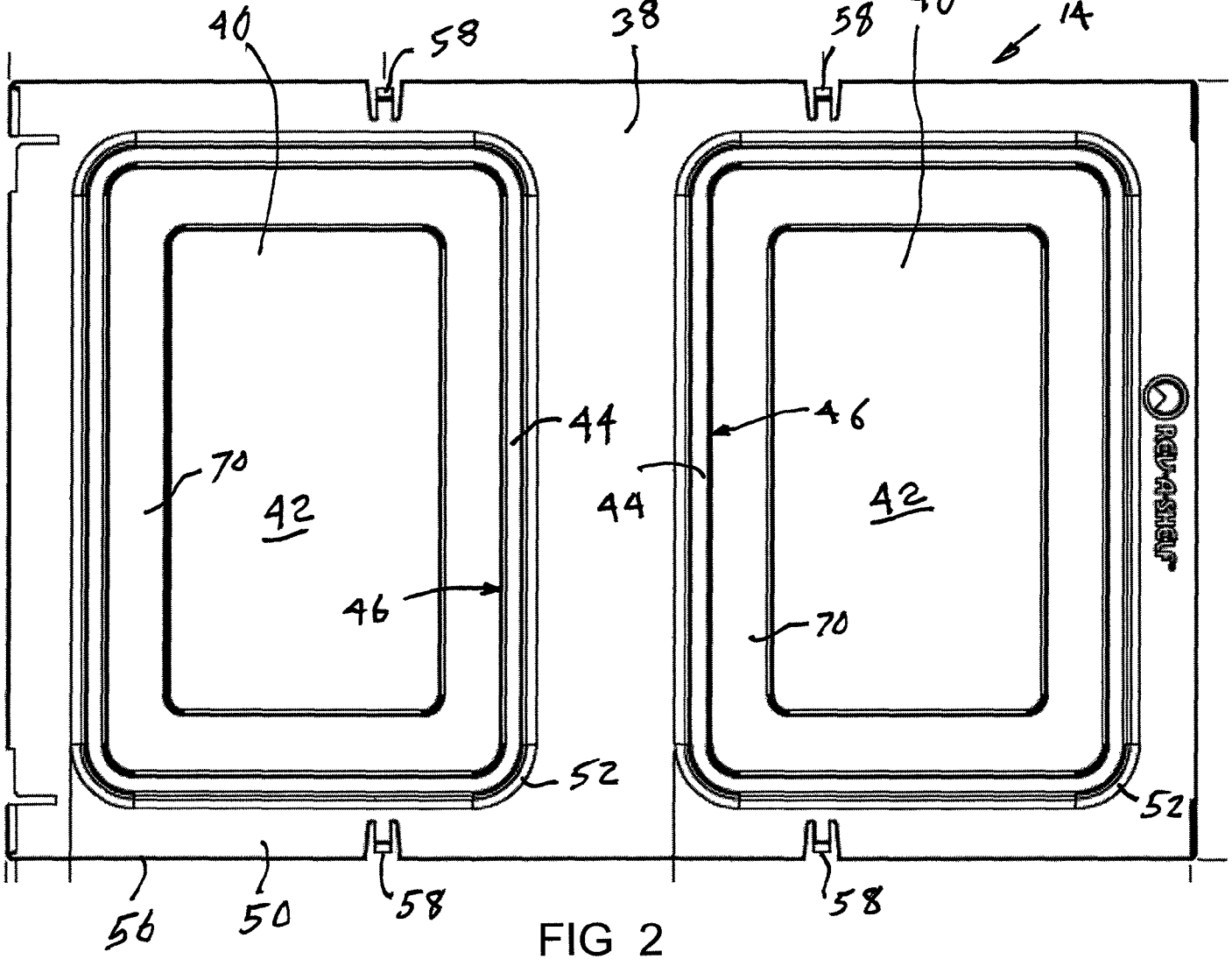
FIG. 2 is a top plan view of a molded drawer floor.
Figure 3:
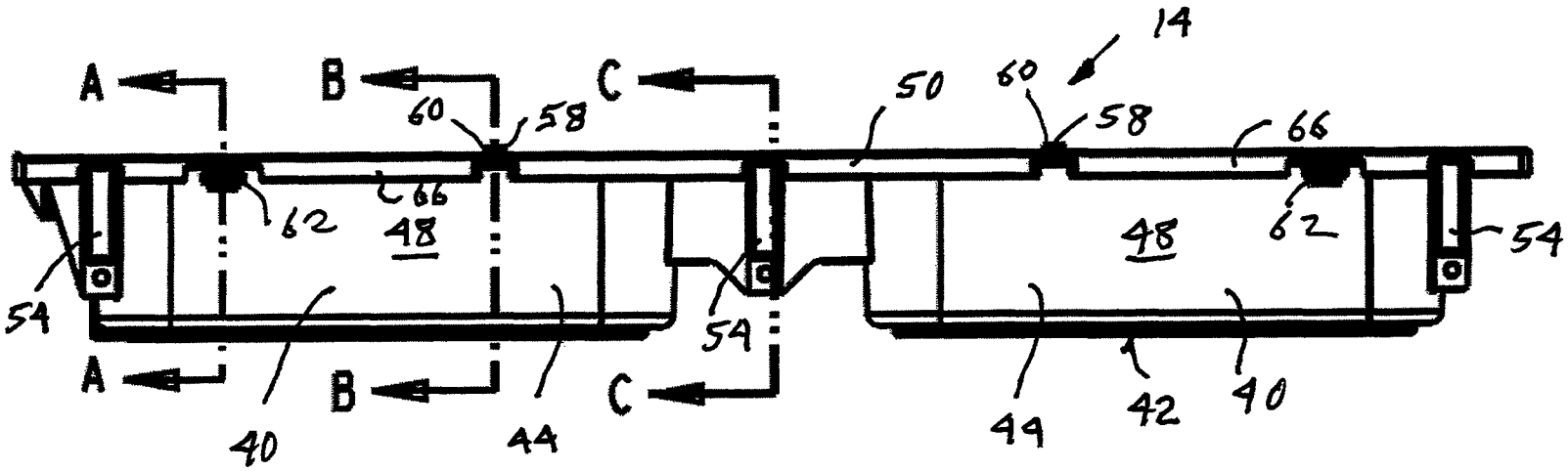
FIG. 3 is a side elevation view of the molded drawer floor of FIG. 2.
Figure 4:
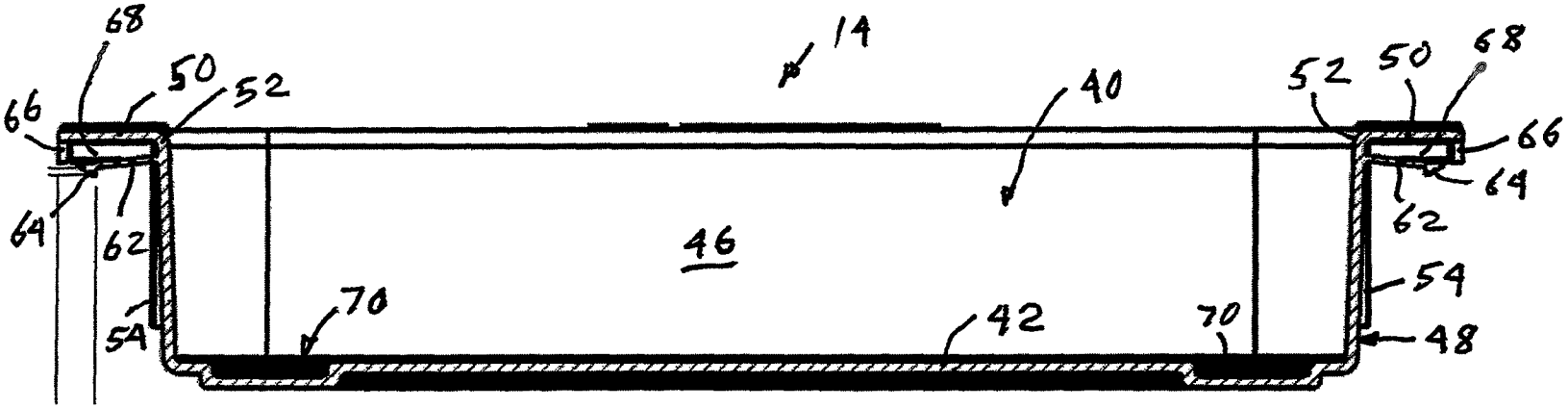
FIG. 4 is a sectional view taken along line A-A of FIG. 3.

FIG. 1 shows a drawer 10 suitable for installation in a cabinet such as a kitchen cabinet (not shown). The drawer 10 can have a base 12 which can be adjustably positioned and secured within a cabinet. The drawer 10 can also have a molded floor 14. Drawer slides 16 can be secured to the molded floor 14 and to the base 12 to allow linear movement of the drawer 10 in and out of the cabinet. One or more containers 18 can be supported on the floor 14 for movement in and out of the cabinet with the drawer 10. A fence 20 can be coupled to the molded floor 14 to surround the containers 18 so that the containers 18 are restrained from tipping. The surrounding fence 20 can have two side portions 22, 24. Each side portion 22, 24 can include a skirt portion 26 coupled to the molded floor 14. A lower edge 28 of each skirt portion 26 can be positioned to hide or obscure the drawer slides 16. Each side portion 22, 24 can also include a pair of legs 30 projecting upwardly from the skirt portion 26. A top portion 32 of each fence side 22, 24 can be connected to the upper ends 34 of the legs 30. Tie bars 36 can be secured to the upper ends 34 of the legs 30 at both ends of the drawer 10 to define an upper perimeter of the fence 20.

Figure 5:
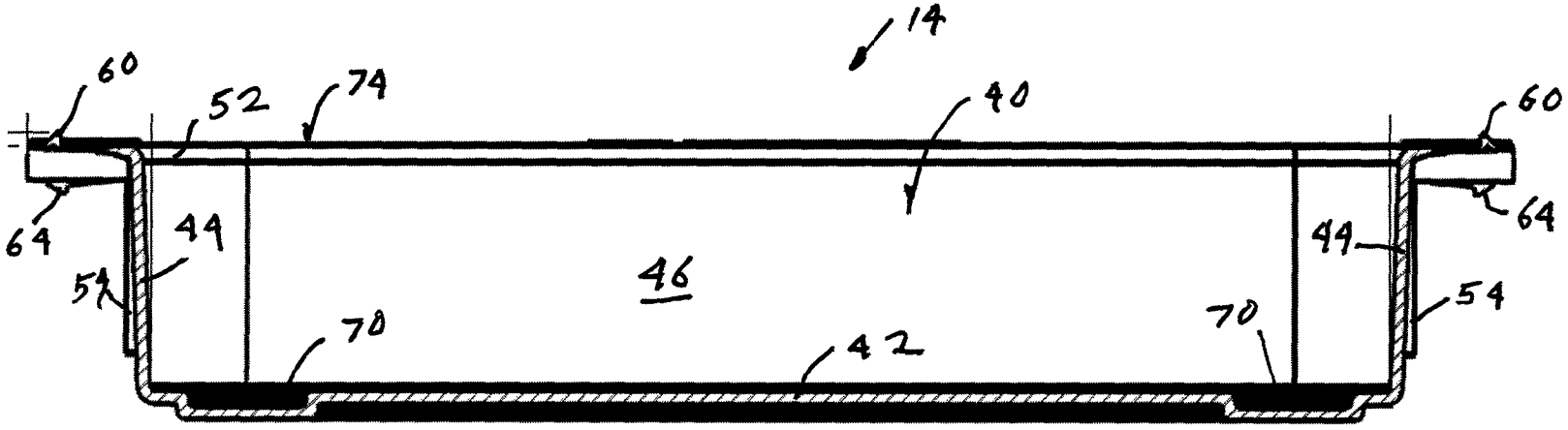
FIG. 5 is a sectional view taken along line B-B of FIG. 3.
Figure 6:
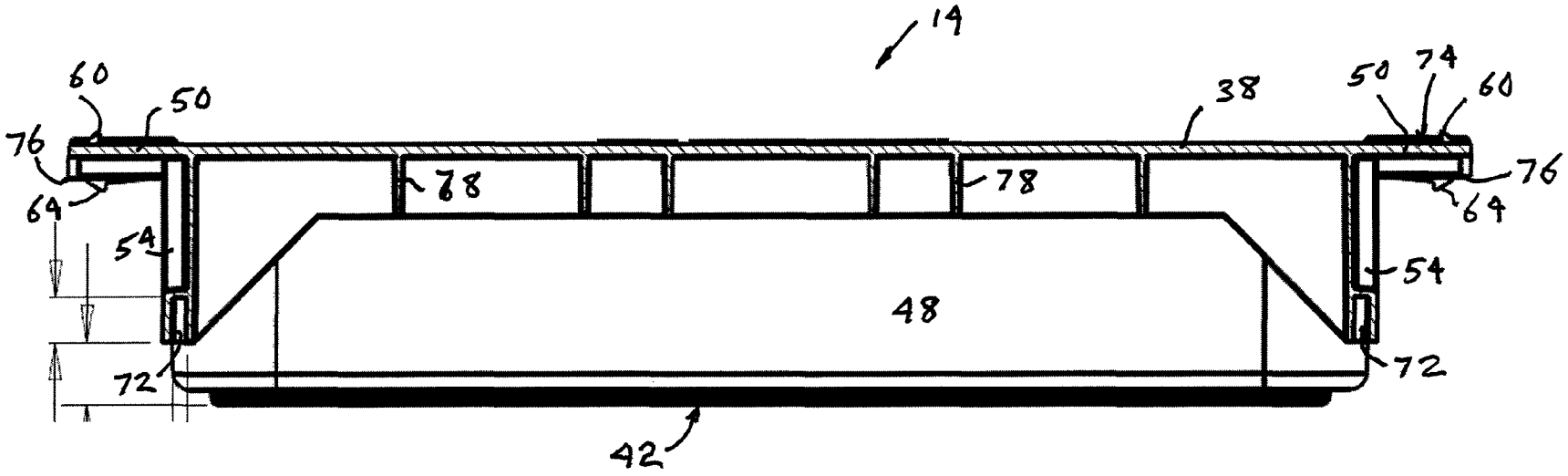
FIG. 6 is a sectional view taken along line C-C of FIG. 3.

FIGS. 2-6 show a first possible molded drawer floor 14 that can be used in the drawer 10. The molded drawer floor 14 can have a central portion 38 including a pair of depressions 40. Each depression 40 can have a bottom wall 42 and a sidewall 44. The side wall 44 can have an inner surface 46 and an outer surface 48 seen in FIGS. 3-6. A flange 50 can extend outwardly from an upper edge 52 of the depressions 40. Webs 54, shown in FIGS. 3 and 6, can extend outward from the outer surface 48 of the sidewall 44 of the depressions 40. Openings 72 can be provided in webs 54 as shown in FIG. 6 for connection with the drawer slides 16. A peripheral edge 56 of the flange 50 can include a plurality of deflectable tabs 58 for coupling to the surrounding fence 20. Each of the plurality of deflectable tabs 58 on the peripheral edge of the flange 50 can include a projection 60 directed in a first selected direction, shown in FIGS. 3, 5, and 6 to be upward. The drawer floor 14 can further include a second plurality of deflectable tabs 62 projecting outward from the outer surface 48 of each depression 40. Each of the second plurality of deflectable tabs 62 can include a projection 64 directed in a second selected direction opposite the first selected direction. The projections 60 preferably extend above the upper surface 74 of flange 50 as shown in FIG. 5. A lip 66 can depend downwardly from the peripheral edge 56 of the flange 50. The projections 64 preferably extend below the lower edge 76 of lip 66 as shown in FIG. 6. A plurality of ridges 68 can be provided on a lower surface of the flange 50 extending between the lip 66 and the outer surface 48 of the depression 40. Additional ridges 78 can be provided on the bottom surface of the central portion 38 as shown in FIG. 6. The bottom wall 42 of each depression 40 can include a U-shaped trough 70 spaced inward from the sidewall 44.

Figure 7:
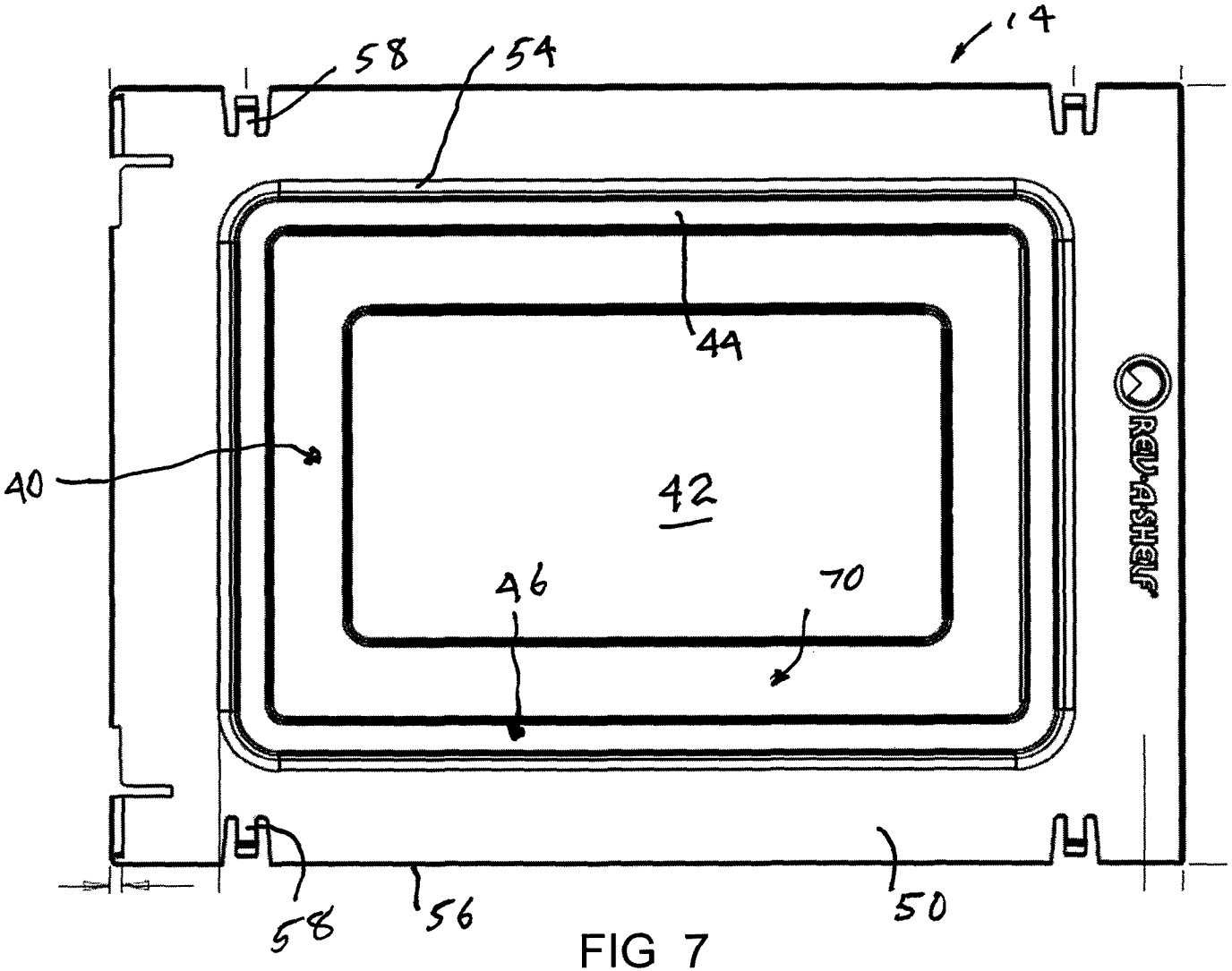
FIG. 7 is a top plan view of another molded drawer floor.
Figure 8:
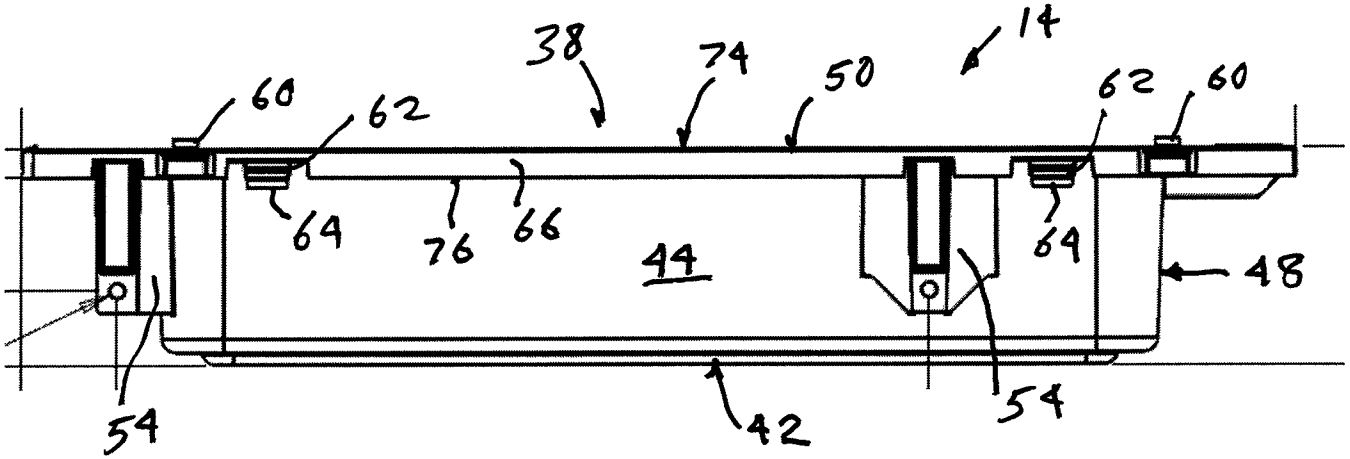
FIG. 8 is a side elevation view of the molded drawer floor of FIG. 7.

FIGS. 7 and 8 show another possible molded drawer floor 14 that can be used in the drawer 10. The molded drawer floor 14 can have a central portion 38 including a single depression 40. The depression 40 can have a bottom wall 42 and a sidewall 44. The side wall 44 can have an inner surface 46, and an outer surface 48 seen in FIG. 8. A flange 50 can extend outwardly from an upper edge 52 of the depression 40. Webs 54, shown in FIG. 8, can extend outward from the outer surface 48 of the sidewall 44 of the depression for connection with the drawer slides 16. A peripheral edge 56 of the flange 50 can include a plurality of deflectable tabs 58 on both sides of the drawer floor 14 for coupling to the surrounding fence 20. Each of the plurality of deflectable tabs 58 on the peripheral edge of the flange 50 can include a projection 60 directed in a first selected direction, shown in FIG. 8 to be upward. The drawer floor 14 can further include a second plurality of deflectable tabs 62 projecting outward from the outer surface 48 of each depression 40. Each of the second plurality of deflectable tabs 62 can include a projection 64 directed in a second selected direction opposite the first selected direction. The projections 60 preferably extend above the upper surface 74 of flange 50, as shown in FIG. 8. A lip 66 can depend downwardly from the peripheral edge 56 of the flange 50. The projections 64 preferably extend below the lower edge 76 of lip 66 as shown in FIG. 8. The bottom wall 42 of the depression 40 can include a U-shaped trough 70 spaced inward from the sidewall 44.

Figure 9:
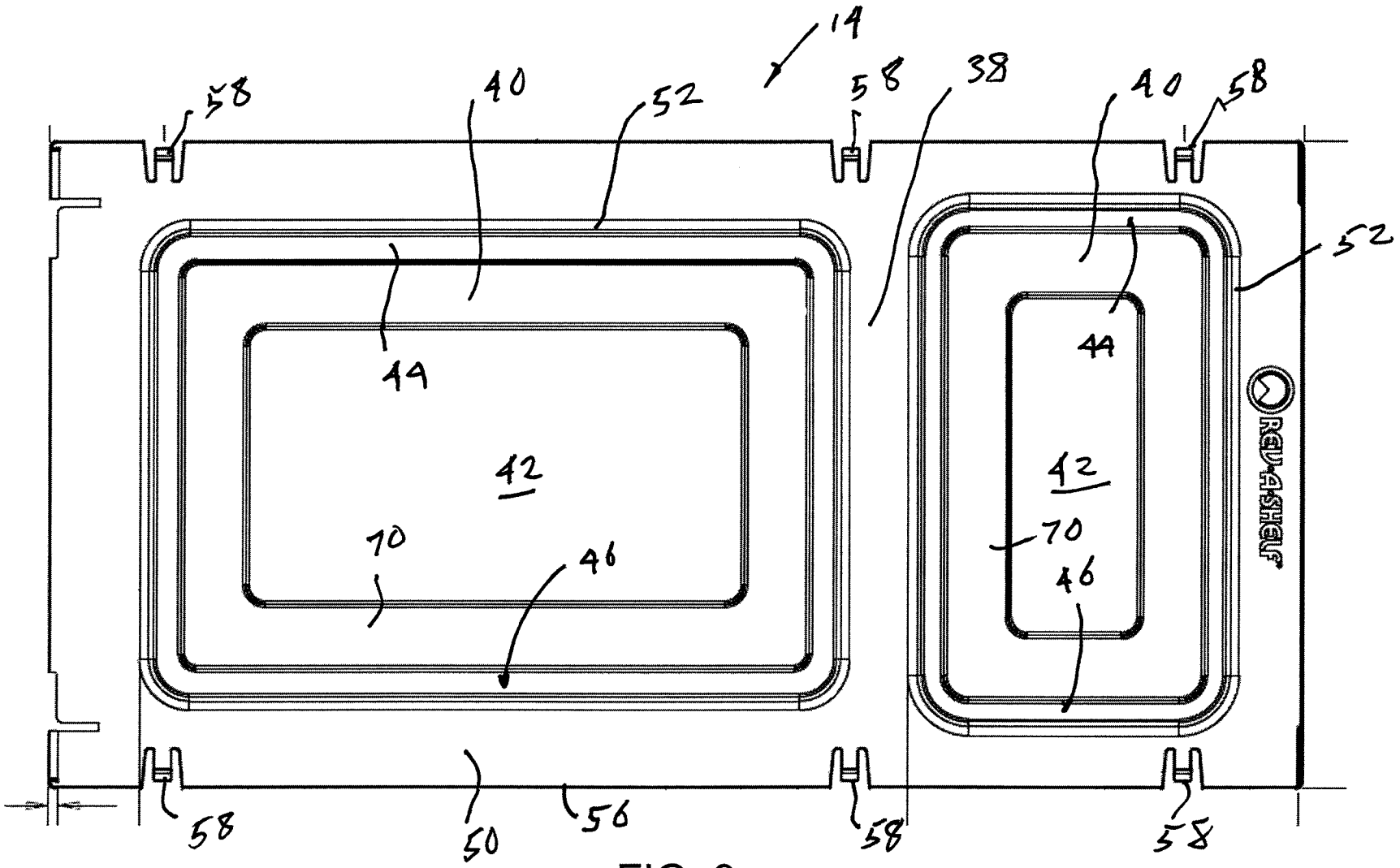
FIG. 9 is a top plan view of another molded drawer floor.
Figure 10:
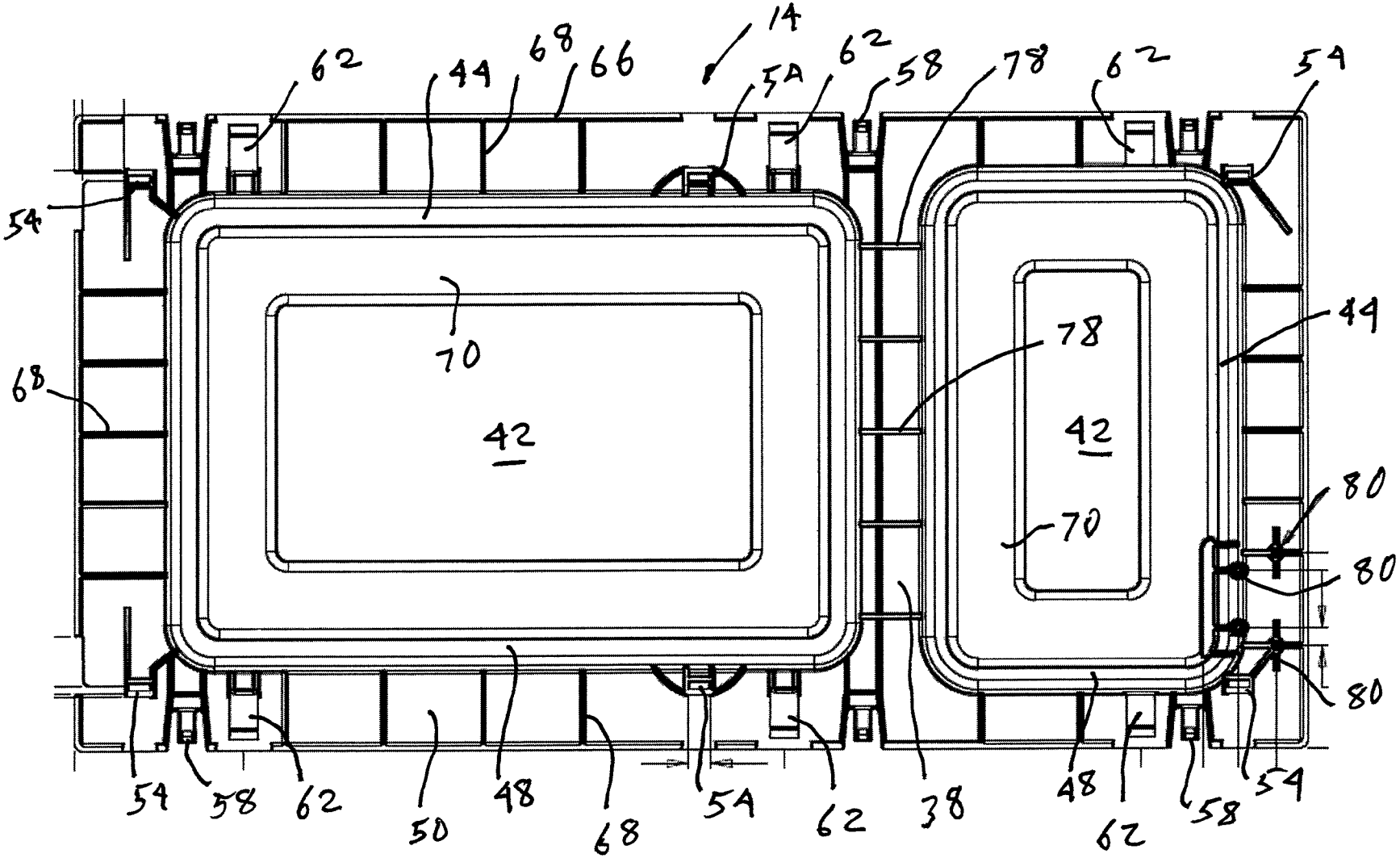
FIG. 10 is a bottom plan view of the molded drawer floor of FIG. 9.

FIGS. 9 and 10 show yet another possible molded drawer floor 14 that can be used in the drawer 10. The molded drawer floor 14 can have a central portion 38 including a pair of depressions 40 of differing size and orientation. Both of the depressions 40 can have a bottom wall 42 and a sidewall 44. The side wall 44 can have an inner surface 46, and an outer surface 48 seen in FIG. 10. A flange 50 can extend outwardly from an upper edge 52 of the depressions 40. Webs 54, shown in FIG. 10, can extend outward from the outer surface 48 of the sidewall 44 of the depressions 40 for connection with the drawer slides 16. A peripheral edge 56 of the flange 50 can include a plurality of deflectable tabs 58 on both sides of the drawer floor 14 for coupling to the surrounding fence 20. The drawer floor 14 can further include a second plurality of deflectable tabs 62 projecting outward from the outer surface 48 of each depression 40. A lip 66 can depend downwardly from the peripheral edge 56 of the flange 50. A plurality of ridges 68 can be provided on a lower surface of the flange 50 extending between the lip 66 and the outer surface 48 of the depression 40. Additional ridges 78 can be provided on the bottom surface of the central portion 38 as shown in FIG. 10. Additional webs 80 can extend outward from the outer surface 48 of the depression 40 for attachment to a soft-close apparatus. The bottom wall 42 of each of the depressions 40 can include a U-shaped trough 70 spaced inward from the sidewall 44.

Figure 11:
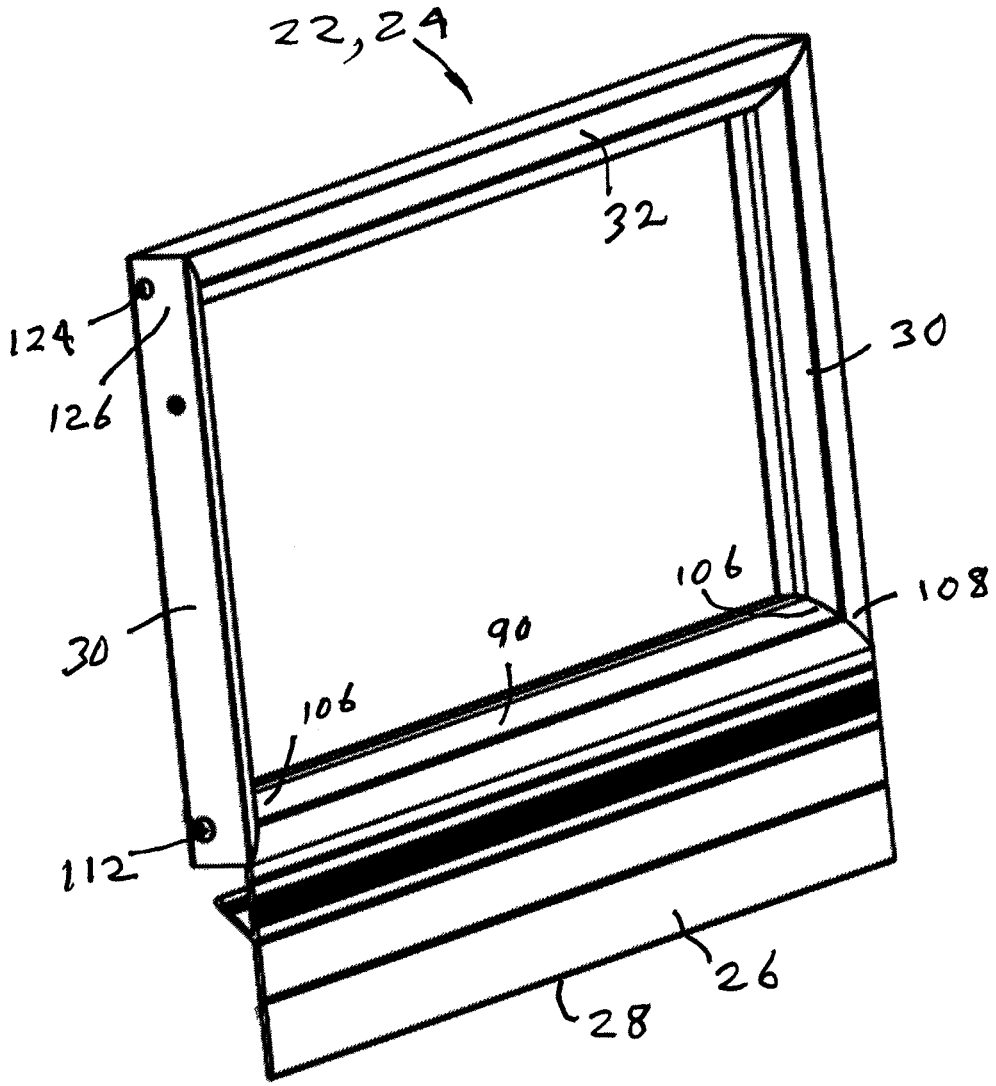
FIG. 11 is a perspective view of one side of fence.

FIG. 11 shows one side 22 or 24 of fence 20, both of which are preferably substantially identical to each other. Each side portion 22, 24 can include a skirt portion 26 that can be coupled to a molded floor 14. A lower edge 28 of each skirt portion 26 can be dimensioned so as to be positionable to hide or obscure the drawer slides 16. Each side portion 22, 24 can also include a pair of legs 30 projecting upwardly from the skirt portion 26. A top portion 32 of each fence side 22, 24 can be connected to the upper ends 34 of the legs 30. The lengths of legs 30 and top portion 32 can be varied based on the length of the molded floor 14 and the desired height of the fence 20. The skirt portion 26, legs 30 and top portion 32 can have a variety of shapes and can be conveniently made of aluminum or other metal by an extrusion process to have the desired configuration. In one embodiment, the skirt portion 26 can have the shape shown in FIG. 12, and the legs 30 and top portion 32 can have the shape shown in FIG. 13.

Figure 12:
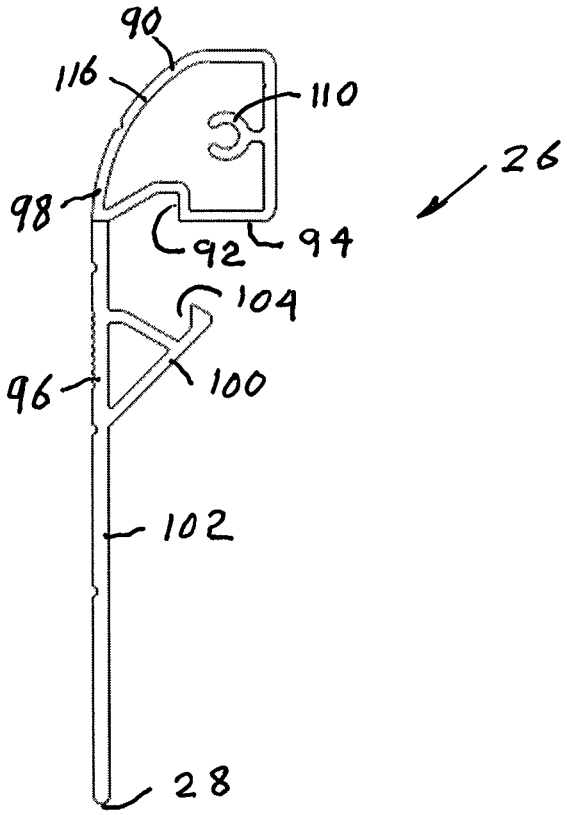
FIG. 12 is a sectional view of the skirt of the fence of FIG. 11.
Figure 13:
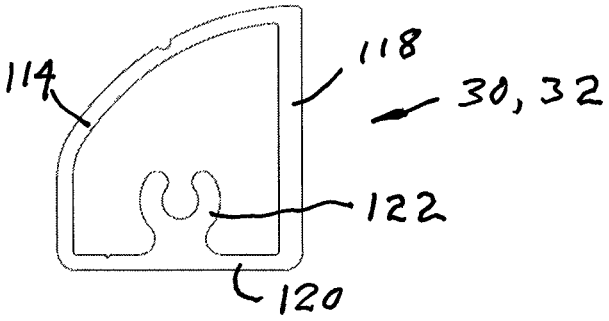
FIG. 13 is a sectional view of the vertical post of the fence of FIG. 11.
Figure 14:
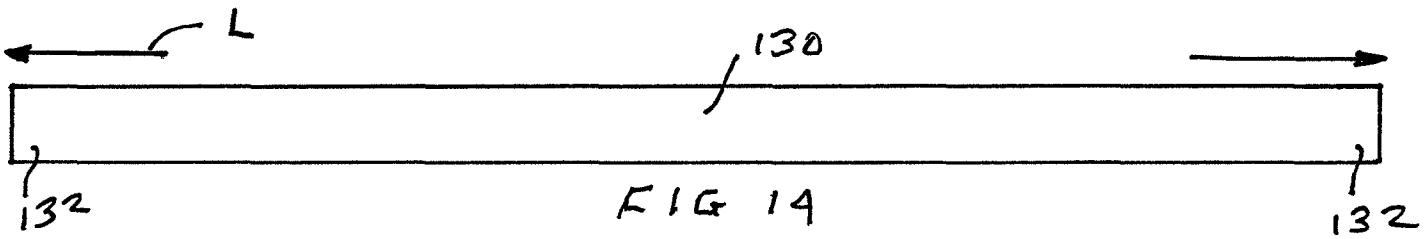
FIG. 14 is a schematic view of a segment of hollow bar stock used to form one side of the fence.
Figure 15:
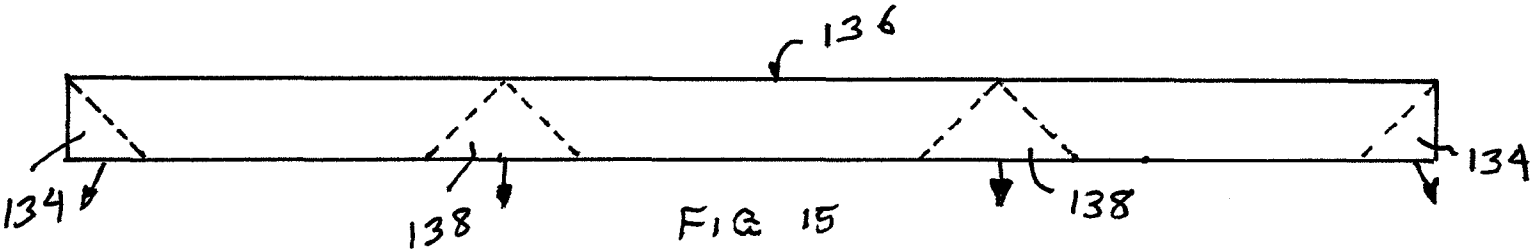
FIG. 15 is a schematic view of the cuts to be made to the hollow bar stock of FIG. 14.
Figure 16:
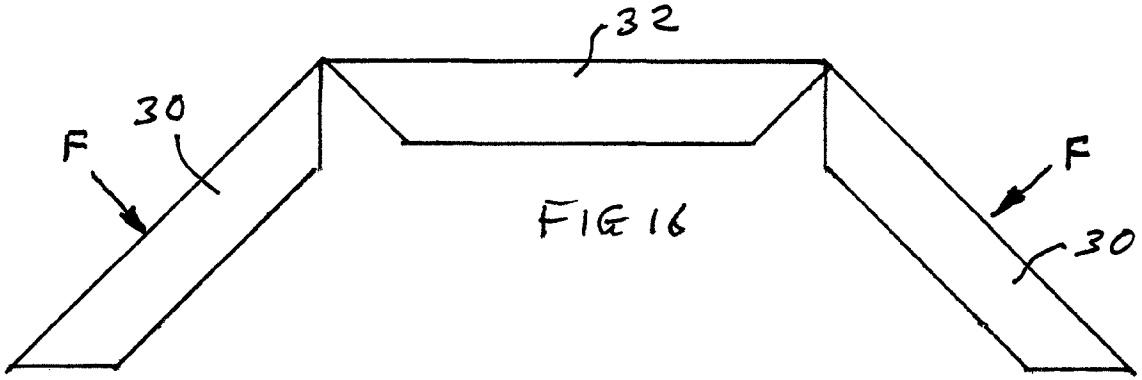
FIG. 16 is a schematic view of the bending forces to be applied to the cut hollow bar stock of FIG. 15.
Figure 17:
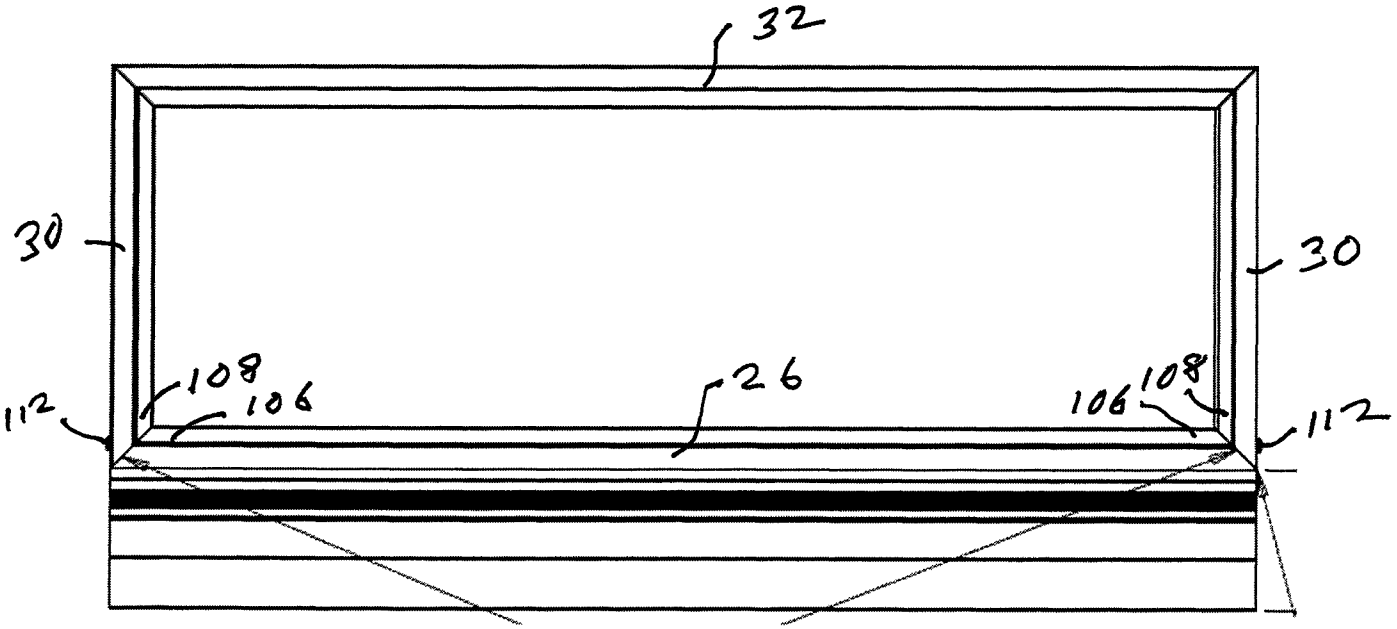
FIG. 17 is an elevation view of one side of the fence.

As shown in FIG. 12, the skirt portion 26 has a tubular upper portion or margin 90. A step 92 can be provided on a lower surface 94 of the upper margin 90 for engaging at least one of the deflectable tabs 58 on a molded floor 14. A planar member 96 can extend downward from an outer surface 98 of the tubular upper margin 90 to the lower edge 28. A flange 100 can be directed inwardly from an inner surface 102 of the planar member 96. A step 104 can be provided by an upper edge of the flange 100 for engaging at least one of the deflectable tabs 62 on a molded floor 14. As shown in FIG. 11, the tubular upper margin 90 can have ends 106 that are mitered to connect to the lower ends 108 of the legs 30. The tubular upper margin 90 can also include an interior web 110 adapted to receive fasteners 112 coupling the lower ends 108 of the legs 30 to the ends 106 of the skirt portion 26. As shown in FIG. 13, legs 30 and top portion 32 can be a tubular member having a curved outer wall 114 that can be identical to the curved outer wall 116 of the skirt portion 26. The legs 30 can have two planar walls 118 and 120 that can be arranged at right angles to each other. An interior web 122 can be provided that can receive fasteners 124 coupling the top portion 32 to the upper ends 126 of legs 30.

While legs 30 and top portion 32 of the sides 22, 24 of the fence 20 can be made independently of each other, a preferred method of manufacturing each side 22, 24 is shown in FIGS. 14-17. In a preferred method, a hollow bar stock 130 is selected having a total length L equal to the length of the top portion 32 and both legs 30 of one side 22 or 24. Both ends 132 of the hollow bar stock 130 are cut on a diagonal and the corner portions 134 are removed. Two triangular cuts are made in such a way as to leave the upper wall 136 of the hollow bar stock 130 intact, and the two triangular portions 138 are removed. A bending force F is then applied to the upper wall 136 of the hollow bar stock 130 at two positions outside the locations of the removal of the triangular portions 138, causing the hollow bar stock 130 to bend to form in a single unitary piece the legs 30 and top portion 32. The ends 108 of the legs 30 can then be secured to ends 106 of skirt portion 26 by fasteners 112. Thus, each side 22, 24 of the fence 20 can be quickly assembled using only two fasteners 112.

Each side 22, 24 of the fence 20 can be quickly coupled to a molded floor 14 by simply pushing the skirt portion 26 toward the flange 50 so that the peripheral edge is inserted between the lower wall 94 of the tubular upper margin 90 and the upper edge of flange 100. The pushing force on the skirt portion 26 causes the deflectable tabs 58 to engage step 92 and the deflectable tabs 62 to engage step 104. Thus each side 22, 24 of the fence 20 can be secured to the molded floor without use of any separate fasteners. Tie bars 36 can be secured to the upper ends 34 of the legs 30 at both ends of the drawer 10 to define an upper perimeter of the fence 20.

Other variations in dimension will become apparent to those skilled in the art that are still within the scope of the invention as defined in the following claims. The foregoing detailed description should be regarded as merely illustrative rather than limiting, and the following claims, including all equivalents, are intended to define the spirit and scope of this invention.

The invention claimed is:

1. A molded drawer floor comprising: a central portion including at least one depression, each depression having a bottom wall and a sidewall having an inner surface and an outer surface, a flange extending outwardly from an upper edge of the at least one depression, a plurality of webs extending outward from the at least one depression outer surface for connection with a drawer slide system, a peripheral edge of the flange including a plurality of coupling mechanisms integrally formed with the flange and a lip depending downwardly from the peripheral edge, wherein a plurality of ridges on a lower surface of the flange extending between the lip and the outer surface of the at least one depression, and the coupling mechanism is engageable with a skirt positioned adjacent the lip.

2. The molded drawer floor of claim 1, wherein the plurality of coupling mechanisms include a plurality of first deflectable tabs having an upward projection, and the drawer floor further comprises a second plurality of deflectable tabs projecting outward from the outer surface of the at least one depression.

3. The molded drawer floor of claim 1, wherein the bottom wall of each of the at least one depressions includes a U-shaped trough spaced inward from the sidewall.

4. The molded drawer floor of claim 1, wherein the coupling mechanisms include a plurality of interlocking tabs.

5. The molded drawer floor of claim 1, wherein the skirt includes opposing sides, and the coupling mechanism engages with a step included on only one of the opposing sides to position the lip in contiguous alignment with the skirt.

6. A drawer comprising:

a support including a base adapted for location within a cabinet, a first pair of drawer slides fixed to the base, and a second pair of drawer slides movable relative to the first pair of draw slides;

a molded drawer floor having a central portion including at least one depression, a plurality of webs connected to the second pair of drawer slides for movement therewith, a peripheral edge including a plurality of coupling mechanisms; and a surrounding fence including a skirt portion, the skirt portion comprising a planar member extending downwardly, and a flange directed inwardly from an inner surface of the planar member, the flange including a step on an upper surface of the flange to engage at least one of the coupling mechanisms.

7. The drawer of claim 6, wherein each depression has a bottom wall and a sidewall having an inner surface and an outer surface, wherein the peripheral edge is on a flange extending outwardly from an upper edge of the at least one depression, and wherein the plurality of webs extend outwardly from the at least one depression outer surface.

8. The drawer of claim 7, wherein the plurality of coupling mechanisms include a plurality of first deflectable tabs include an upward projection, and the drawer floor further comprises a second plurality of deflectable tabs projecting outward from the outer surface of the at least one depression.

9. The drawer of claim 8, wherein the skirt portion comprises a tubular upper margin including a step on a lower surface engaging at least one of the deflectable tabs.

10. The drawer of claim 9, wherein the surrounding fence further comprises a plurality of legs projecting upwardly from the skirt portion, and a top perimeter portion connected to upper ends of the plurality of legs, the plurality of legs projecting upwardly from the skirt portion have a surface shape corresponding to the tubular upper margin of the skirt portion.

11. The drawer of claim 6, wherein the surrounding fence further comprises a plurality of legs projecting upwardly from the skirt portion, and a top perimeter portion connected to upper ends of the plurality of legs.

12. The drawer of claim 11, wherein the top perimeter portion comprises end portions spanning the drawer widthwise and side portions extending lengthwise along the drawer, the side portions being formed unitarily with the legs projecting upwardly from the skirt portion.

13. A combination comprising: a molded drawer floor having a central portion including at least one depression comprising a sidewall, and a flange coupled with the sidewall, the flange including a peripheral edge and a plurality of coupling mechanisms; and a surrounding fence including a skirt portion coupled to the coupling mechanisms of the floor peripheral edge such that the skirt portion extends downwardly away from the flange over the peripheral edge, a plurality of legs projecting upwardly from the skirt portion away from the flange, and a top perimeter portion connected to upper ends of the plurality of legs.

14. The combination of claim 13, wherein each depression of the molded drawer floor has a bottom wall and the sidewall includes an inner surface and an outer surface, wherein the flange extends outwardly from an upper edge of the at least one depression, and wherein the plurality of webs extend outwardly from the at least one depression outer surface.

15. The combination of claim 14, wherein the plurality of coupling mechanisms include a plurality of first deflectable tabs include an upward projection, and the drawer floor further comprises a second plurality of deflectable tabs projecting outward from the outer surface of the at least one depression.

16. The combination of claim 15, wherein the skirt portion comprises a tubular upper margin including a step on a lower surface engaging at least one of the deflectable tabs, a planar member extending downward from an outer surface of the tubular upper margin, and a flange directed inwardly from an inner surface of the planar member, the flange including an step on an upper surface of the flange.

17. The combination of claim 16, wherein the top perimeter portion comprises end portions spanning the drawer widthwise and side portions extending lengthwise along the drawer, the side portions being formed unitarily with the legs projecting upwardly from the skirt portion.

18. The combination of claim 17, wherein the side portions are formed of a hollow bar stock having an interior web adapted to receive fasteners to secure lower ends of the legs to the skirt portion.

19. A method of assembly of a cabinet drawer comprising providing a drawer floor having a plurality of coupling mechanisms, assembling side portions of a fence, the fence including a skirt portion having steps on an inner surface, pressing the side portions of the fence onto the drawer floor until the coupling mechanism of the drawer floor engage the steps on the skirt portion of the side portions, and tying the upper ends of the side portions to each other.

20. The method of claim 19, wherein the assembling step includes cutting triangular portions from a hollow bar stock at two locations separated by a desired length a side portion so that the hollow bar stock remains continuous, bending the hollow bar stock at the two locations so that ends of the hollow bar stock can be secured to ends of the skirt portion.

21. The method of claim 20, wherein the assembling step also includes mitering the ends of the hollow bar stock and the skirt portion, and coupling lower ends of legs to the ends of the skirt portion so that the legs project upwardly from the skirt portion.

* * * * *